US008237073B2

(12) United States Patent
Ting et al.

(10) Patent No.: US 8,237,073 B2
(45) Date of Patent: Aug. 7, 2012

(54) KEY STRUCTURE OF A KEYBOARD

(75) Inventors: Yu-Hsiang Ting, Tu-Cheng (TW); Chia-Fa Cheng, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 454 days.

(21) Appl. No.: 12/651,653

(22) Filed: Jan. 4, 2010

(65) Prior Publication Data

US 2010/0314231 A1 Dec. 16, 2010

(30) Foreign Application Priority Data

Jun. 12, 2009 (TW) ..... 98210473 U

(51) Int. Cl.
*H01H 13/70* (2006.01)

(52) U.S. Cl. ..... 200/344; 200/345

(58) Field of Classification Search ..... 200/344
See application file for complete search history.

(56) References Cited

U.S. PATENT DOCUMENTS 5,298,706 A * 3/1994 English et al. ..... 200/517
5,525,979 A * 6/1996 Engle et al. ..... 341/32
5,718,327 A * 2/1998 Wu ..... 200/344
7,312,414 B2 * 12/2007 Yatsu et al. ..... 200/344

* cited by examiner

*Primary Examiner* — Renee S Luebke
*Assistant Examiner* — Lheiren Mae Caroc
(74) *Attorney, Agent, or Firm* — Rosenberg, Klein & Lee

(57) ABSTRACT

A key structure of a keyboard includes a cap having a cover and a key post protruded under the cover, a key base which has a base board, restraining posts and a guiding post protruded on the base board with being arranged and spaced to surround a receiving space thereamong, and a resilient dome with a recessed passageway mounted between the cover and the base board to receive the key post and the posts in the passageway. The key post includes a base pillar and guiding ribs arranged around the base pillar. A guiding channel is opened in an inside of the guiding post to communicate with the receiving space and passes through a top of the guiding post. The key post is movably inserted in the receiving space with one guiding rib being slidably inserted in the guiding channel and the other guiding ribs being resisted against the respective restraining posts.

4 Claims, 4 Drawing Sheets

KEY STRUCTURE OF A KEYBOARD

BACKGROUND OF THE INVENTION

1. Field of the Invention

The present invention relates to a key structure of a keyboard, and more particularly to a key structure of a keyboard for a computer keyboard.

2. The Related Art

A conventional key structure of a keyboard includes a cap, a key base, and a resilient rubber dome. The cap has a post extending from an underside thereof The post of the cap is axially movably received in a guide channel defined in the key base, and capable of deforming the rubber dome to contact and trigger an associated circuit to generate a corresponding signal. In order to prevent deflection of the post of the cap in the guide channel and ensure stable axial movement of the post, sidewalls of the post of the cap are resisted against sidewalls of the guide channel of the key base. However, the post of the cap may not move easily and fluently due to the friction between the sidewalls of the post and the sidewalls of the guide channel of the key base. What is needed, therefore, is a key structure having a post capable of moving fluently and easily due to less the friction between a cap and a key base thereof.

SUMMARY OF THE INVENTION

An object of the present invention is to provide a key structure of a keyboard which is adapted for acting onto a circuit board to generate a corresponding signal. The key structure includes a cap, a key base and a resilient dome. The cap has a cover and a key post extending downward from a bottom surface of the cover. The key post includes a base pillar and a plurality of guiding ribs arranged and spaced around the base pillar. The key base has a base board. A top surface of the base board protrudes upward to form a plurality of restraining posts and a guiding post which are arranged and spaced from one another to surround a receiving space thereamong. A guiding channel is opened in an inside of the guiding post to communicate with the receiving space and passes through a top of the guiding post. The circuit board is mounted on the base board by means of the restraining posts and the guiding post being inserted through the circuit board. The resilient dome with a recessed passageway penetrating therethrough is mounted between the cover of the cap and the circuit board to receive the key post, the restraining posts and the guiding post in the passageway. The key post of the cap is further movably inserted in the receiving space of the key base with one of the guiding ribs being slidably inserted in the guiding channel for preventing deflection of the key post and the other guiding ribs being resisted against the respective restraining posts so that the cover of the cap can be pressed downward to make the base pillar contact and trigger the circuit board so as to generate the corresponding signal.

As described above, each guiding rib of the cap contacts the corresponding post substantially along a tangent line. Thus, the friction between the guiding ribs of the cap and the posts of the key base is so little that the movement of the key post in the receiving space will be unhindered.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
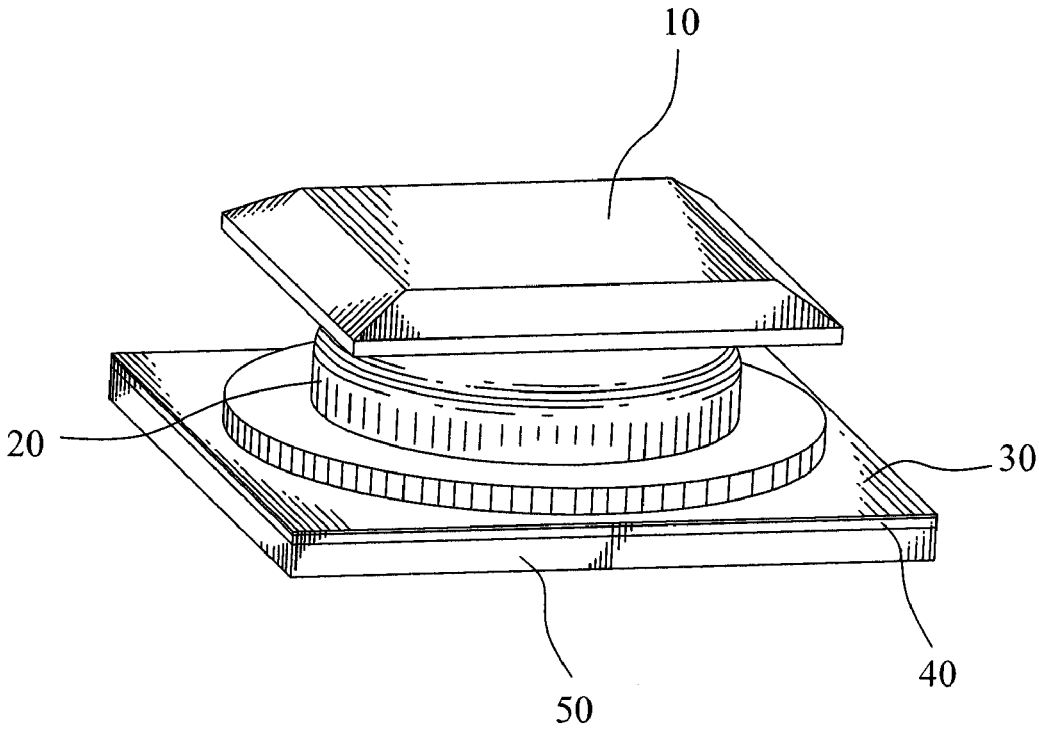
FIG. 1 is a perspective view of a key structure of a keyboard in accordance with the present invention.
Figure 2:
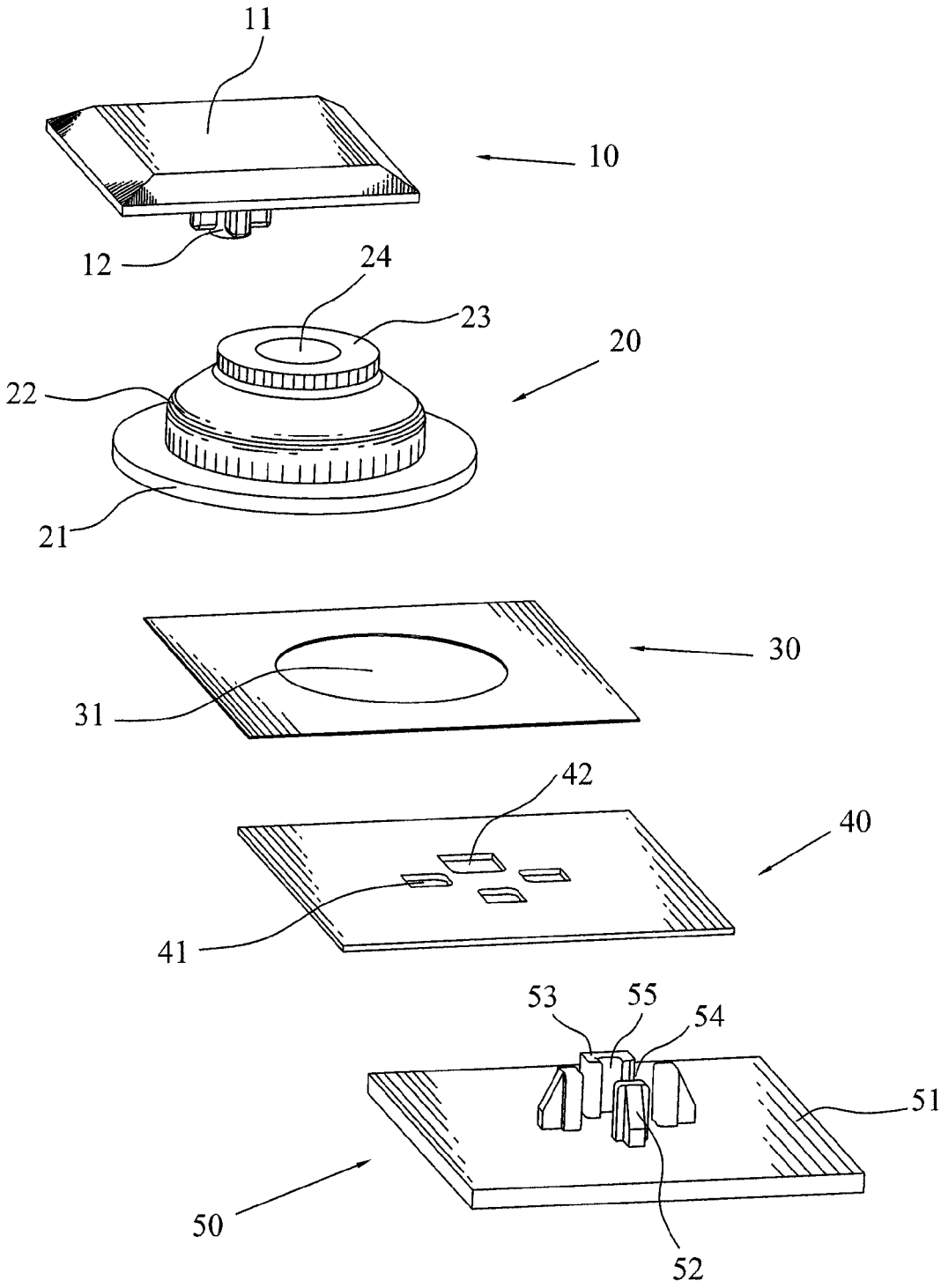
FIG. 2 is an exploded view of the key structure of a keyboard of FIG. 1.

Referring to FIG. 1 and FIG. 2, a key structure of a keyboard for a computer keyboard in accordance with the present invention is adapted for acting onto a circuit board 40 to generate a corresponding signal for the computer. The key structure includes a cap 10, a resilient dome 20, a spacer board 30 and a key base 50.

Figure 3:
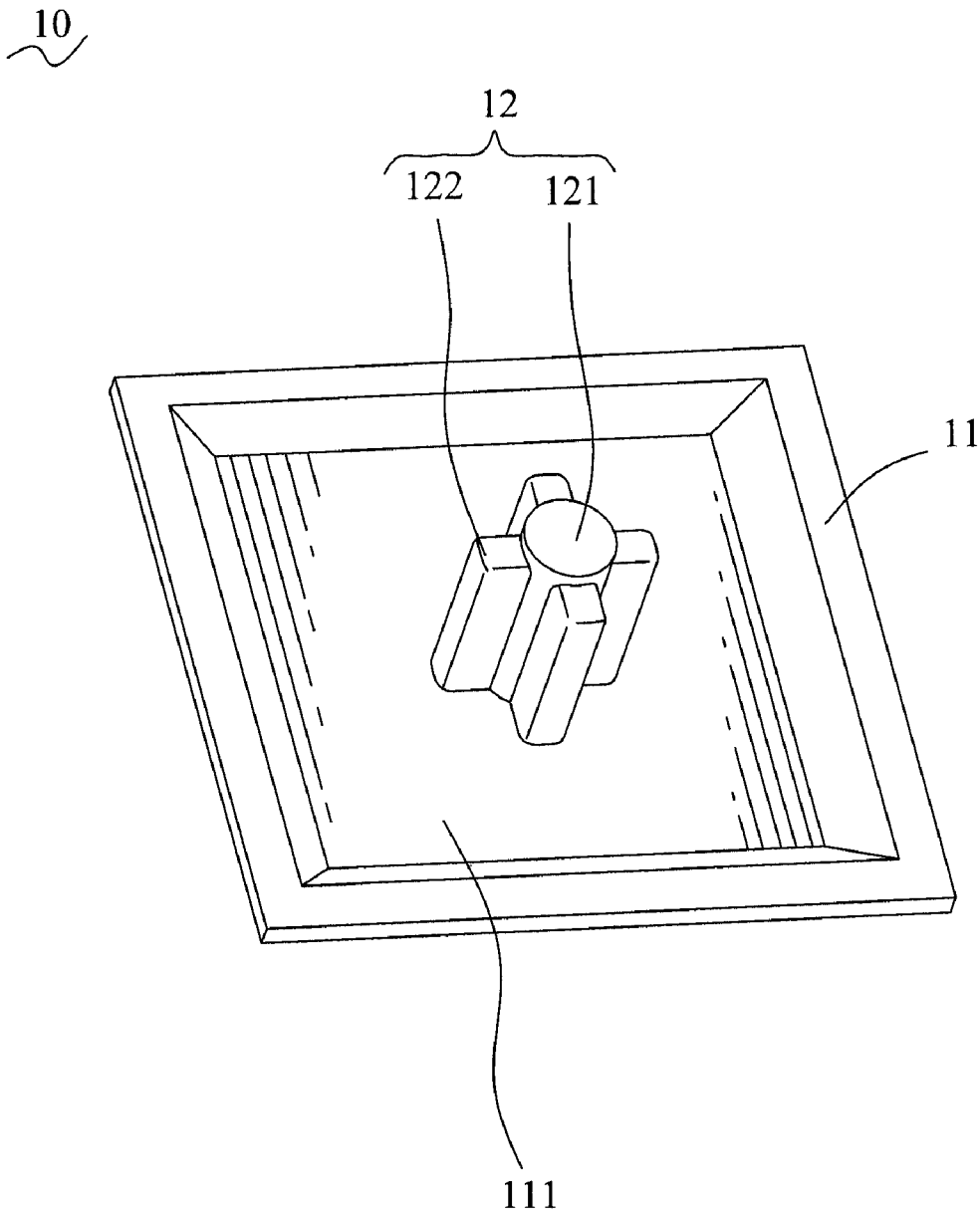
FIG. 3 is a perspective view of a cap of the key structure of a keyboard of FIGS. 1.

Referring to FIG. 2 and FIG. 3, the cap 10 includes a cover 11 of rectangular board shape and a key post 12 extending downward from a middle of a bottom surface 111 of the cover 11. The key post 12 includes a base pillar 121 and four guiding ribs 122 symmetrically arranged around the base pillar 121. Each of the guiding ribs 122 extends along a generatrix of the base pillar 121 and has a shorter length than the base pillar 121.

Referring to FIG. 2 again, the resilient dome 20 has a ring-shaped top slice 23, a ring-shaped bottom slice 21 wider than the top slice 23, and a connecting body 22 of hollow truncated cone shape connecting an inside peripheral edge of the bottom slice 21 and an outside peripheral edge of the top slice 23 with leaving a recessed passageway 24 through the top slice 23, the connecting body 22 and the bottom slice 21. The spacer board 30 is made of plastic material with a circular hole 31 opened in a center thereof The diameter of the hole 31 is slightly less than a greatest diameter of the passageway 24.

Referring to FIG. 2 again, the key base 50 has a rectangular base board 51 disposed levelly. A middle of the base board 51 protrudes upward to form three restraining posts 52 and a guiding post 53 which are arranged and spaced from one another to surround a receiving space 54 thereamong. A guiding channel 55 is opened in an inside of the guiding post 53 to communicate with the receiving space 54 and extends vertically to penetrate through the guiding post 53. A middle of the circuit board 40 defines three first inserting apertures 41 and a second inserting aperture 42 which are arranged and spaced from one another for engaging with the restraining posts 52 and the guiding post 53 respectively.

Figure 4:
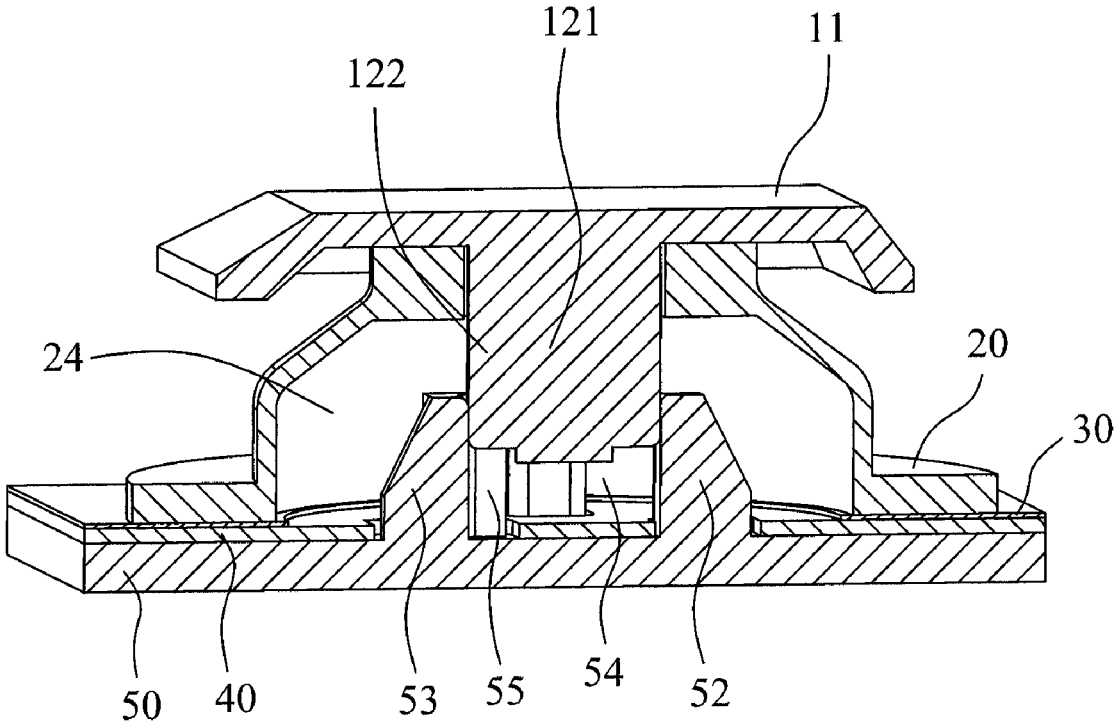
FIG. 4 is a cross-sectional view of the key structure of a keyboard of FIG. 1.

Referring to FIG. 1, FIG. 2 and FIG. 4, the resilient dome 20 is fixed under the cap 10 by means of the top slice 23 being molded on the bottom surface 111 of the cover 11 as a single piece, wherein the key post 12 is inserted in the passageway 24. The spacer board 30 is gummed under the bottom slice 21 of the resilient dome 20 with the hole 31 coaxially communicating with the passageway 24. The circuit board 40 is fastened on the base board 51 of the key base 50 by means of the restraining posts 52 being inserted through the corresponding first inserting apertures 41 and the guiding post 53 being inserted through the second inserting aperture 42. Then the spacer board 30 is stuck onto the circuit board 40 with the restraining posts 52 and the guiding post 53 passing through the hole 31 of the spacer board 30 to stretch into the passageway 24 of the resilient dome 20 so that the key post 12 of the cap 10 is axially movably inserted in the receiving space 54 of the key base 50, wherein one of the guiding ribs 122 is slidably inserted in the guiding channel 55 for preventing deflection of the key post 12 and the other guiding ribs 122 are resisted against the respective restraining posts 52. In use, the cover 11 of the cap 10 is pressed downward to make the base pillar 121 contact and trigger the circuit board 40 so as to generate a corresponding signal for the computer.

As described above, each of the guiding ribs 122 of the cap 10 contacts the corresponding post 52/53 substantially along a tangent line. Thus, the friction between the guiding ribs 122 of the cap 10 and the posts 52, 53 of the key base 50 is so little that the movement of the key post 12 in the receiving space 54 will be unhindered.

What is claimed is:

1. A key structure of a keyboard adapted for acting onto a circuit board to generate a corresponding signal, comprising:

a cap having a cover and a key post extending downward from a bottom surface of the cover, the key post including a base pillar and a plurality of guiding ribs arranged and spaced around the base pillar;

a key base having a base board, a top surface of the base board protruding upward to form a plurality of restraining posts and a guiding post which are arranged and spaced from one another to surround a receiving space thereamong, a guiding channel being opened in an inside of the guiding post to communicate with the receiving space and passing through a top of the guiding post, the circuit board being mounted on the base board by means of the restraining posts and the guiding post being inserted through the circuit board; and a resilient dome with a recessed passageway penetrating therethrough, the resilient dome being mounted between the cover of the cap and the circuit board to receive the key post, the restraining posts and the guiding post in the passageway, wherein the key post of the cap is further movably inserted in the receiving space of the key base with one of the guiding ribs being slidably inserted in the guiding channel for preventing deflection of the key post and the other guiding ribs being resisted against the respective restraining posts so that the cover of the cap can be pressed downward to make the base pillar contact and trigger the circuit board so as to generate the corresponding signal.

2. The key structure of a keyboard as claimed in claim 1, wherein each of the guiding ribs extends along a generatrix of the base pillar.

3. The key structure of a keyboard as claimed in claim 1, wherein one end of the resilient dome is fixed under the cover of the cap by means of being molded on the bottom surface of the cover as a single piece.

4. The key structure of a keyboard as claimed in claim 1, further comprising a spacer board made of plastic material with a hole therein, the spacer board being fixed on an end of the resilient dome with the hole communicating with the passageway so as to make the restraining posts and the guiding post pass therethrough to extend into the passageway.

* * * * *